US006774291B2

(12) United States Patent
Vartiainen

(10) Patent No.: US 6,774,291 B2
(45) Date of Patent: Aug. 10, 2004

(54) ELECTRIC GUITAR OR ELECTRIC BASS

(76) Inventor: Juha Vartiainen, Sotkanniemi 75 70780 Hiltulanlahti, Kuopio (FI)

( * ) Notice: Subject to any disclaimer, the term of this patent is extended or adjusted under 35 U.S.C. 154(b) by 0 days.

(21) Appl. No.: 10/265,885

(22) Filed: Oct. 7, 2002

(65) Prior Publication Data

US 2003/0066406 A1 Apr. 10, 2003

(30) Foreign Application Priority Data

Oct. 8, 2001 (FI) ..... 20011951

(51) Int. Cl.[7] ..... G10D 3/00

(52) U.S. Cl. ..... 84/291; 84/293; 84/267

(58) Field of Search ..... 84/291, 267, 293

(56) References Cited

U.S. PATENT DOCUMENTS

| | | | | | |
|---|---|---|---|---|---|
| 4,829,870 | A | * | 5/1989 | Ralston | 84/291 |
| 4,873,908 | A | | 10/1989 | Moore | 84/291 |
| 5,889,221 | A | * | 3/1999 | Dejima | 84/291 |
| 6,025,548 | A | * | 2/2000 | Ehrlich | 84/291 |
| 6,194,644 | B1 | | 2/2001 | Hendrickson | 84/291 |

* cited by examiner

*Primary Examiner*—Shih-Yung Hsieh
(74) *Attorney, Agent, or Firm*—Harrington & Smith, LLP

(57) ABSTRACT

The object of the invention is an electric guitar or electric bass, which includes a body, a neck, strings attached to the neck and to the body, an attaching mechanism and locking tuners of the strings and at least one pickup placed near the strings. According to the invention the body comprises of at least two separate parts attached within distance from one another. Furthermore the body comprises of attaching parts to attach the parts together.

5 Claims, 2 Drawing Sheets

ELECTRIC GUITAR OR ELECTRIC BASS

The present invention relates to an electric guitar or electric bass, which includes a body, a neck, strings attached to the neck and to the body, an attaching mechanism and locking tuners of the strings and at least one pickup placed near the strings.

BACKGROUND OF THE INVENTION

There are mainly three different types of electric guitars nowadays; an electric guitar with solid body, so called solid body, an electric guitar with a partly hollow body, so called semi-acoustic guitar and an electric guitar with a wholly hollow body, so called orchestra guitar. The sound in these different kinds of types of guitars differs from one another quite a lot. Furthermore, there are different qualities in regard to the sound in guitars of the same type manufactured in different ways by construction and of different materials.

One of the aims of professional guitarists and bassists is to find an own style that differs as much as possible from the style of other guitarists. That is why they want their own music to stand out in a way that pleases the ear of a listener and is distinctive to them. Present electric guitars enable to create various sounds within the bounds of constructional differences of electric guitars, such as the material of the body and various parts. Nevertheless, because there are lots of players that play the same type of a guitar it is often difficult to find a noticeable different sound from the players of the same type of a guitar using at present known electric guitars.

The purpose of the invention is to provide an electric guitar or electric bass with which the earlier mentioned disadvantages in sound related to electric guitars and electric basses and to music created with them are eliminated. Especially, the purpose of the invention is to provide an electric guitar or electric bass, which enables electro-guitarists to create different sounds that differ from the sound of other guitarists more than earlier. Furthermore, the purpose of the invention is to provide an electric guitar or electric bass, which may be classified by acoustic properties and by sound surroundings between the solid body and semi-acoustic guitar.

DESCRIPTION OF THE INVENTION

Characteristic to the electric guitar or electric bass in accordance with the invention is that the body is comprised of at least two separate parts attached within distance from one another and of attaching parts to attach the parts together. Such is created an electric guitar or electric bass, which differs by sound from a solid body and from a partly hollow semi-acoustic guitar. This way this kind of an electric guitar or electric bass with sandwich construction gives electro-guitarists possibilities to find different kinds of sounds clearly differing from the style of other guitarists. Furthermore, this kind of an electric guitar is relatively simple and economical to manufacture because of its construction.

In an advantageous embodiment of the invention the body has been comprised of a backbody and of a top and the neck has been attached to the back body. Strings are attached to the tailpiece on the top of the body. Such the most part of the vibration of the strings and the sound such created are transmitted directly to the top. Because the top is a separate part within a distance from the neck and the backbody it may vibrate on a different natural frequency in regard with them. Thus is created a new sound that differs from earlier known electric guitars being more airy, warmer and acoustic stronger than that of a solid body.

In the second advantageous embodiment of the invention the attaching parts are separate. Furthermore, the attaching parts are located within a distance from the edges of the body. With attaching parts placed like this a new sound differing acoustic from the earlier electric guitars is achieved. Furthermore, these kind of attaching parts enable with ease and economically to use various kinds of materials in the top and backbody of the guitar.

In the third advantageous embodiment of the invention there are at least four attaching parts. In case the top and the backbody are made of wood they may be attached to each other in a durable and advantageous in respect with the sound way by means of 4–6 attaching parts. In case the top and the backbody are made of four attaching parts achieve some more flexible artificial material the desired strength and sound.

In the fourth advantageous embodiment of the invention the attaching parts include a space plate, which has been fixed between the top and the backbody by screw elements. At least a part of the screw elements has been attached to the top and at least a part has been attached to the backbody. Such may the top and the backbody be attached to each other within a distance from one another relatively solid and durable but unnoticed without parts of attaching parts outside the body. Furthermore, a space plate attached such vibrates with the top and the backbody of the body without making sound such that by means of it the attachment may be accomplished flexible in respect with the sound but without inconvenient resonance sounds.

In the fifth advantageous embodiment of the invention the screw elements have been attached to the lower surface of the top and to the nut elements on the upper surface of the backbody and between the nut elements and the space plate there are base plates to support the space plate between the top and the backbody within a distance from the lower surface of the top and the upper surface of the backbody. Due to this kind of construction of attaching parts bolts may be advantageously be used as screw elements, such that the attachment of body parts may be accomplished removable as well as very durably and keeping the stiffness. This secures the sound to stay as unchanged as possible in spite of the age of the guitar and the quantity or the way of playing. Furthermore, the attachment accomplished as earlier mentioned is soundless, such that it does not cause inconvenient resonance sounds having influence on the sound of the guitar.

In the sixth advantageous embodiment of the invention the backbody includes holes at the point of the screw elements of the top in order to screw on and off the screw elements of the top. There must be holes or corresponding at least in one part of the body to enable the assembly of attaching parts functioning as mentioned earlier. The holes in the backbody are more advantageous than the holes in the top because while playing the guitar they stay on the player side out of sight.

DESCRIPTION OF THE DRAWINGS

Next, the invention will be explained in more detail with reference to the accompanying drawings, in which.

Figure 1:
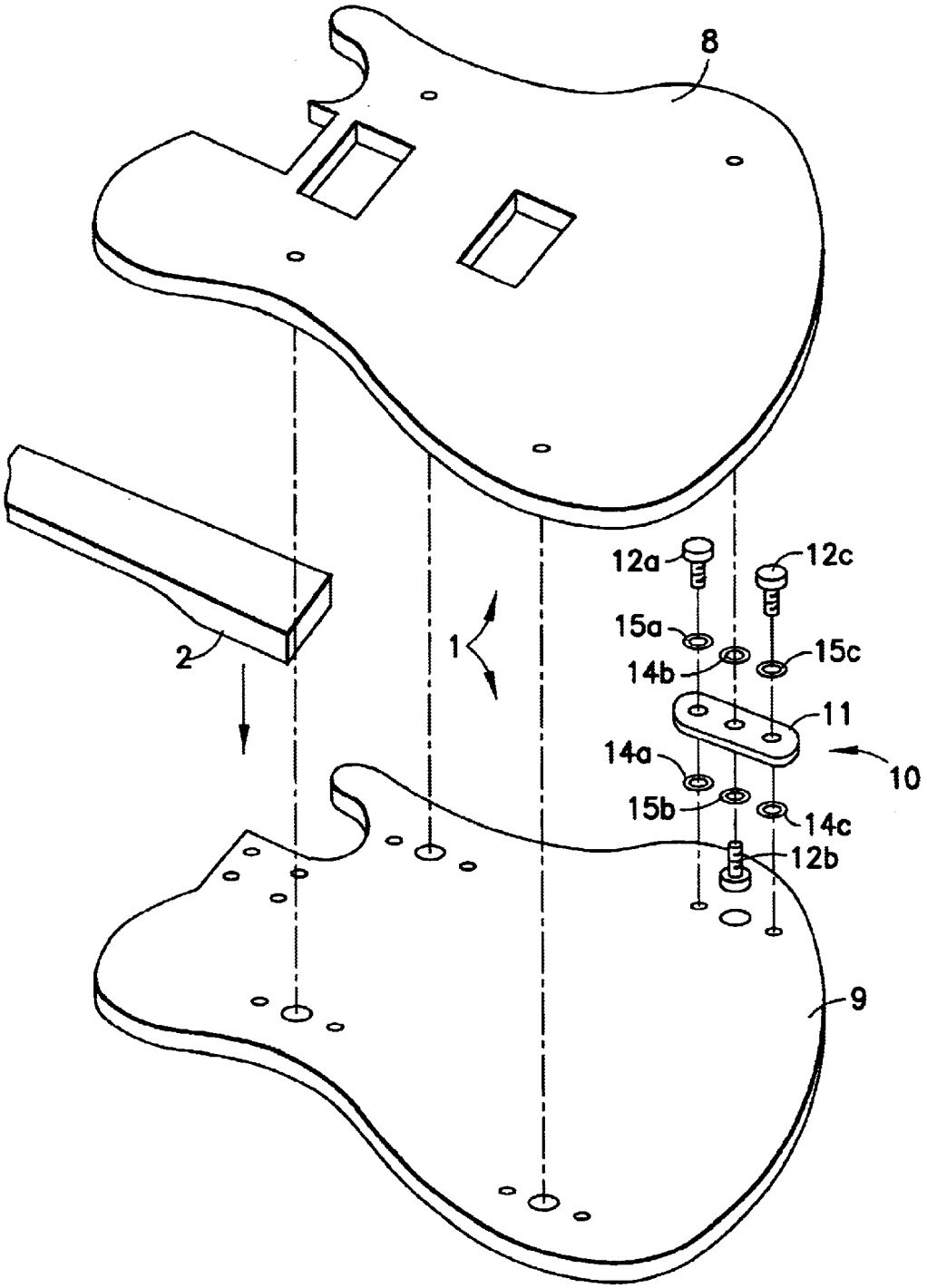
FIG. 1 illustrates a perspective view of the body and the neck of the electric guitar in accordance with the invention, in which the body parts are separate.
Figure 2:
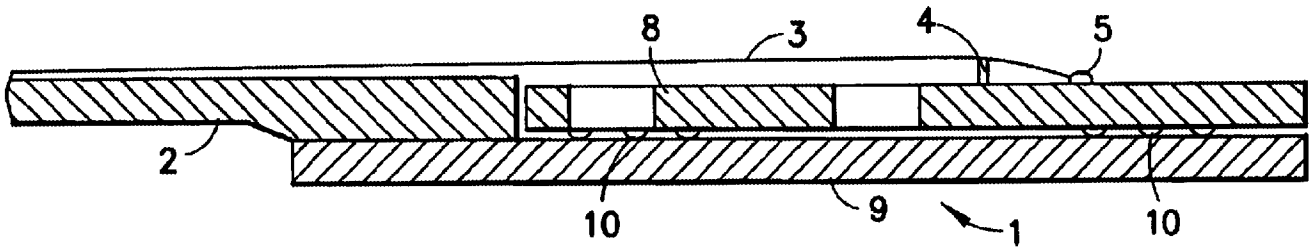
FIG. 2 illustrates a side view of the electric guitar in accordance with FIG. 1.
Figure 3:
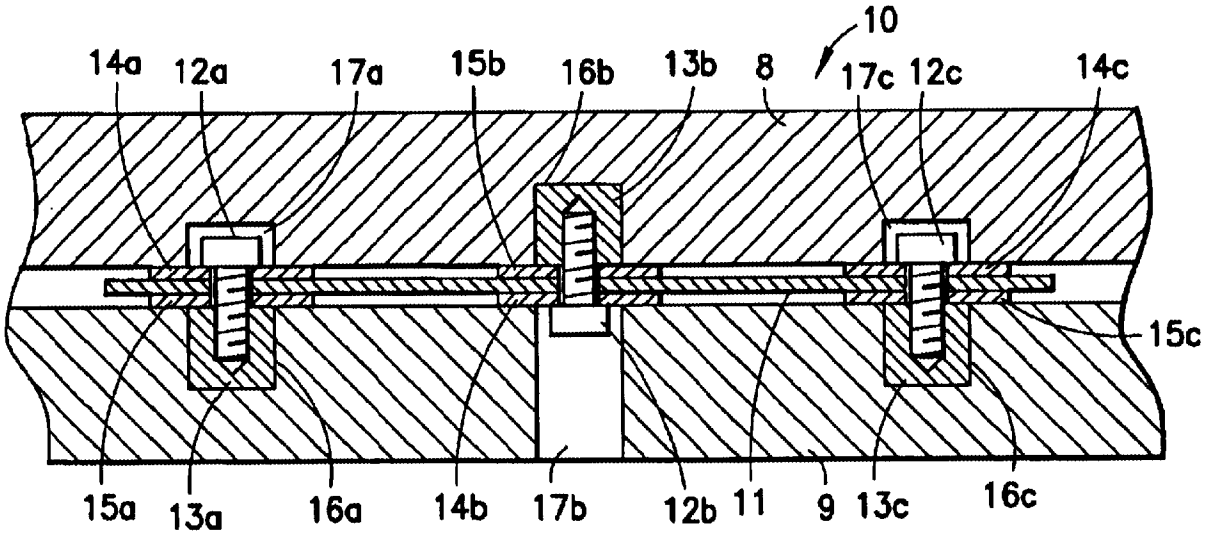
FIG. 3 illustrates a cross section of the body of the electric guitar in accordance with FIGS. 1 and 2 at the point of the attaching part between the body parts.

The electric guitar in accordance with FIGS. 1–3 includes the body with the top 8 and the backbody 9, the neck 2, strings 3 as well as attaching mechanisms and locking tuners of the neck and the body, of which only the bridge 4 and the tailpiece 5 on the body side are illustrated in FIGS. 1 and 2. Furthermore, it includes pickups attached to the body near the strings and earlier recognized connecting parts (not illustrated in FIGS. 1–3) by means of which the electric guitar may be connected to a wanted amplifier in earlier recognized way.

The top 8 and backbody 9 which comprise the body of the electric guitar are manufactured in earlier recognized way of some suitable material, such as of plate parts made of wood, which are shaped in accordance with FIG. 1 to the shape of a body of an electric guitar. The top 8 and the backbody 9 are attached to each other in a distance in accordance with the idea of the invention so that there is a so-called sandwich-structure. In this case it looks as if the body was split into halves leaving a space between the parts such that while looking at the body from the side (from the edge) there is an eye contact to the other side of the body. The attachment of the top and the backbody 9 has been realized in this embodiment by means of four attaching parts 10 illustrated more detailed in FIG. 3, which have been placed in this case in suitable distance from one another and from the edges of the body as illustrated in FIG. 1. The neck of the electric guitar 2 has been attached only to the backbody. In this case the top is attached to the other parts of the electric guitar only through the attaching parts 10 and the strings 3.

The attaching parts 10 between the top 8 and the backbody 9 include the space plate 11, screw elements 12*a*–12*c*, nut elements 13*a*–13*c* and base plates 14*a*–14*c* and 15*a*–15*c*. Nut elements 13*a* and 13*c* have been attached to drillings 16*a* and 16*c* on the upper surface of the backbody 9 as illustrated in FIG. 3 by means of wooden screw thread (not illustrated in FIGS. 1–3) on the outer surface of the nut element. In the, same way the nut element 13*b* has been attached correspondingly to the drilling 16*b* on the lower surface of the top 8. There is a hole 17*b* going through the backbody at the point of the screw element 13*b* in order to screw the screw element 13*b* of the top. Furthermore, there are drillings 17*a* and 17*c* of suitable depth in the top for the heads of the screw elements 12*a* and 12*c*. The space plate 11 has been attached to the backbody 9 by means of screw elements 12*a* and 12*c* and to the top 8 by means of the screw element 12*b*. There are base plates 15*a* and 15*c* between the heads of the screw elements 12*a* and 12*c* and the space plate 11 and there are another base plates 14*a* and 14*c* between the space plate and the nut elements 13*a* and 13*c*. Correspondingly there is a base plate 15*b* between the screw elements 12*b* and the space plate 11 and another base plate 14*b* between the space plate 11 and the nut element 13*b*. This way it has been possible to attach the top and the backbody together by means of a space plate, which is separate from both body parts without body parts touching directly one another. The meaning of this kind of an attachment is to make the top and the backbody to vibrate independently and to connect them together the way mentioned earlier as durable and unnoticed as possible.

The neck 2 of the electric guitar in accordance with FIGS. 1–3 has been attached to the backbody 9 on the attaching point manufactured to it by bolts, the holes of which have been illustrated in FIG. 1. The neck is a usual earlier recognized neck of an electric guitar by construction, in the end of which there are earlier recognized locking tuners of the strings and the nut (not illustrated in FIGS. 1–3). Due to the attachment point of the neck the vibration and the sound from the strings 3 to the neck are transmitted through the neck to the backbody 9. The entirety of the neck and the backbody has for its part together with the top an influence on the acoustic properties of the guitar.

The electric guitar in accordance with the FIGS. 1–3 includes two electromagnetic pickups functioning in earlier recognized way. In this case they have been attached to the top of the body. Because of this the vibration of the top and the backbody is a part of the electric vibration created by the strings. This is why the vibrations of the top and backbody have influence on the sound. This makes the sound of the guitar in earlier mentioned way different from the earlier electric guitars.

The electric guitar in accordance with the invention may be realized also in many ways differing from the embodiment in accordance with FIGS. 1–3. For example, the shape and size of the parts of the body as well as the number and the place of the attaching elements between them may vary. Attaching parts other than used in the embodiment in accordance with FIGS. 1–3 may also be used to attach the parts of the body to each other. In one embodiment in accordance with FIGS. 1–3 the parts of the body have been attached to each other directly with wooden screws to both parts such, that there are base plates of suitable thickness on wooden screws in between the top and the backbody, such that the top and the backbody are within a certain distance from one another. In this kind of an attachment the head part of the wooden screw is placed on the side of the backbody, where there are drillings bigger by diameter than the heads in order to sink the heads inside the backbody out of sight. Further, in another embodiment, corresponding to the earlier mentioned, the attachment has been realized with metal screws such that nut elements have been attached to the drillings on the lower surface of the top in accordance with the embodiment in FIGS. 1–3. Furthermore, in some other embodiment of the guitar in accordance with the invention earlier mentioned ways of attachment have been combined.

Also the construction and the attachment methods of the earlier recognized parts of the electric guitar in accordance with the invention such as the strings, the neck and the pickups may vary in a way corresponding the earlier recognized electric guitars. Furthermore, the electric guitar in accordance with the invention may include various additional equipment/accessories having influence on playability and sound of the electric guitar, which are often used in electric guitars known today.

The construction of the electric guitar in accordance with FIGS. 1–3 may also be applied to an electric bass. In that case the earlier recognized parts of the guitar are parts of an earlier recognized bass (for example, there are four strings), which have been adjusted to the body constructed as earlier mentioned.

The invention is not limited to the presented advantageous embodiments but it can vary within the frames of the idea of the invention.

What is claimed is:

1. Electric guitar or bass, which includes:

a body, a neck, strings attached to the neck and to the body, an attaching mechanism an locking tuners of the strings and at least one pickup placed near the strings;

the body comprises at least two separate parts attached within distance from one another; and the body comprises attaching parts to attach the parts together in which he body comprises of a backbody and of a top, and the neck has been attached to the backbody in which the attaching parts include a space plate which has been fixed between the top and the backbody by screw elements so that at least a part of the screw elements has been attached to the top and at least a part of the screw elements has been attached to the backbody.

2. Electric guitar or bass according to claim 1, in which the attaching parts are separate; and the attaching parts are located within a distance from the edges of the body.

3. Electric guitar or bass according to claim 1, in which there are at least four attaching parts.

4. Electric guitar or bass according to claim 1, in which the screw elements have been attached to the lower surface of the top and to nut elements on the upper surface of the backbody and between the nut elements; and there are base plates to support the space plate between the top and the backbody within a distance from the lower surface of the top and the upper surface of the backbody.

5. Electric guitar or bass according to claim 1, in which the backbody includes holes at the point of the screw elements of the top in order to screw on and off the screw elements of the top.

* * * * *